US010322486B2

(12) United States Patent
Nagaya et al.

(10) Patent No.: US 10,322,486 B2
(45) Date of Patent: Jun. 18, 2019

(54) GRINDING MACHINE

(71) Applicant: JTEKT CORPORATION, Osaka-shi (JP)

(72) Inventors: Hisayuki Nagaya, Kariya (JP); Kikutoshi Okada, Nagoya (JP); Shinji Nishio, Toyohashi (JP); Hidetaka Sugiura, Nishio (JP)

(73) Assignee: JTEKT CORPORATION, Osaka-shi (JP)

( * ) Notice: Subject to any disclaimer, the term of this patent is extended or adjusted under 35 U.S.C. 154(b) by 244 days.

(21) Appl. No.: 15/121,243

(22) PCT Filed: Feb. 18, 2015

(86) PCT No.: PCT/JP2015/054374
§ 371 (c)(1),
(2) Date: Aug. 24, 2016

(87) PCT Pub. No.: WO2015/129516
PCT Pub. Date: Sep. 3, 2015

(65) Prior Publication Data

US 2016/0361789 A1 Dec. 15, 2016

(30) Foreign Application Priority Data

Feb. 25, 2014 (JP) ..... 2014-034363

(51) Int. Cl.
*B24B 5/04* (2006.01)
*B24B 5/35* (2006.01)
(Continued)

(52) U.S. Cl.
CPC ..... *B24B 5/045* (2013.01); *B24B 5/04* (2013.01); *B24B 5/355* (2013.01); *B24B 49/003* (2013.01); *B24B 49/08* (2013.01); *B24B 49/10* (2013.01)

(58) Field of Classification Search
CPC ..... B24B 49/12; B24B 49/02; B24B 49/04; B24B 49/16; B24B 49/00; B24B 49/10; B24B 37/005; B24B 37/013
(Continued)

(56) References Cited

U.S. PATENT DOCUMENTS

2002/0173233 A1* 11/2002 Griffin ..... B24B 37/04 451/8

FOREIGN PATENT DOCUMENTS

JP 58-149153 A 9/1983
JP 0857735 A * 8/1994 ..... B23Q 15/00
(Continued)

OTHER PUBLICATIONS

Machine translation of JPH0857735(A).*
(Continued)

*Primary Examiner* — Monica S Carter
*Assistant Examiner* — Lauren M Beronja
(74) *Attorney, Agent, or Firm* — Oblon, McClelland, Maier & Neustadt, L.L.P.

(57) ABSTRACT

A grinding machine includes a manual rotating handle provided with a rotation detector that outputs a rotation detection signal so that the position of a grinding wheel with respect to a workpiece can be relatively moved in accordance with the rotation detection signal. The grinding machine further includes a grinding wheel, a moving apparatus that moves the position of the grinding wheel with respect to a workpiece W, a proximity detector that outputs a proximity detection signal corresponding to a relative position or a relative distance between the workpiece and the grinding wheel, a manual rotating handle provided with a rotation detector, and a control apparatus that controls the moving apparatus based on the rotation detection signal. The manual rotating handle is provided with a rotational-torque
(Continued)

varying apparatus. The control apparatus controls the rotational-torque varying apparatus based on the proximity detection signal.

12 Claims, 7 Drawing Sheets

(51) Int. Cl.
*B24B 49/00* (2012.01)
*B24B 49/08* (2006.01)
*B24B 49/10* (2006.01)

(58) Field of Classification Search
USPC ..... 451/142, 243, 5, 6, 8–10, 24
See application file for complete search history.

(56) References Cited

FOREIGN PATENT DOCUMENTS

| | | | |
|---|---|---|---|
| JP | 8-57735 | A | 3/1996 |
| JP | 9-62361 | A | 3/1997 |
| JP | 2002-351514 | A | 12/2002 |
| JP | 2006-123138 | A | 5/2006 |

OTHER PUBLICATIONS

International Preliminary Report of Patentability and Written Opinion dated Aug. 30, 2016 in PCT/JP2015/054374 (English translation only).
International Search Report dated May 19, 2015, in PCT/JP2015/054374 filed Feb. 18, 2015.

* cited by examiner

GRINDING MACHINE

TECHNICAL FIELD

The present invention relates to a grinding machine including a manual rotating handle provided with a rotation detector that outputs a rotation detection signal that is an electric signal corresponding to the amount of rotation resulting from an operator's manual operation so that the position of a grinding wheel with respect to a workpiece can be relatively moved in accordance with the rotation detection signal.

BACKGROUND ART

Some grinding machines have an automatic operation mode in which a workpiece is automatically machined by automatically moving the position of a grinding wheel relative to the workpiece in accordance with a program stored in a numerical control apparatus or the like and a manual operation mode in which the workpiece is machined by an operator's manual operation in which the operator operates a manual rotating handle to move the position of the grinding wheel relative to the workpiece.

In conventional hydraulic grinding machines with the manual operation mode, the position of the grinding wheel relative to the workpiece is moved by using the manual rotating handle to apply pressure directly to hydraulic oil for oil pressure that al lows movement of the position of the grinding wheel relative to the workpiece. Thus, when the grinding wheel contacts the workpiece, the grinding wheel (or the workpiece) does not move even if is applied to the hydraulic oil. Thus, a rotational torque that is a torque needed to rotate the manual rotating handle is automatically increased, so that the operator can easily feel the contact between the grinding wheel and the workpiece. In the conventional grinding machines, the operator can recognize subtle (delicate) contact based on the increased rotational torque of the manual rotating handle, and can start to finely (delicately) operate the manual rotating handle after the contact to achieve accurate machining.

Patent Document 1 describes a CNC grinding machine including a table feeding manual handle (corresponding to the manual rotating handle) and a wheel spindle stock-feeding manual handle (corresponding to the manual rotating handle) and having a manual operation mode. In the manual operation mode, each manual handle causes a pulse generator to generate a pulse corresponding to the amount of rotation, and the pulse is input to a control unit that outputs an amount of control corresponding to the pulse to a servo motor to move the position of the table or the grinding wheel.

PRIOR ART DOCUMENTS

Patent Documents

Patent Document 1: Japanese Patent Application Publication No. 2006-123138 (JP 2006-123138 A)

SUMMARY OF THE INVENTION

Problem to be Solved by the Invention

In recent years, grinding machines have prevailed which, for various purposes such as improvement of controllability, machining accuracy, and maintainability, control the position of the grinding wheel or the table using the servo motor instead of hydraulically controlling the position of the grinding wheel or the table. The CNC grinding machine described in Patent Document 1 also controls the position of the grinding wheel or the table using the servo motor instead of hydraulically controlling the position of the grinding wheel or the table.

However, in the grinding machine described in Patent Document 1, when, for example, the operator manually moves the grinding wheel in the manual operation mode by operating the wheel spindle stock-feeding manual handle, the rotational torque of the wheel spindle stock-feeding manual handle is not changed even when the grinding wheel and the workpiece come into contact with each other. Consequently, the operator fails to feel the contact between the grinding wheel and the workpiece. Therefore, even though the grinding wheel and the workpiece are in contact with each other, the grinding wheel may be operated to further cut into the workpiece, possibly precluding accurate machining.

The present invention has been developed in view of these circumstances. An object of the present invention is to provide a grinding machine including a manual rotating handle provided with a rotation detector that outputs a rotation detection signal that is an electric signal corresponding to the amount of rotation resulting from an operator's manual operation so that the position of a grinding wheel with respect to a workpiece can be relatively moved in accordance with the rotation detection signal. The grinding machine allows the operator to feel a state of proximity between the grinding wheel and the workpiece and assists accurate machining based on the operator's manual operation.

Means for Solving the Problem

A grinding machine according to an aspect of the present invention includes:

- a grinding wheel that grinds a workpiece;
- a moving apparatus that relatively moves a position of the grinding wheel with respect to the workpiece;
- a proximity detector that outputs a proximity detection signal corresponding to a distance between the workpiece and the grinding wheel;
- a manual rotating handle provided with a rotation detector that outputs a rotation detection signal that is an electric signal corresponding to an amount of rotation resulting from an operator's manual operation; and
- a control apparatus that receives the rotation detection signal to control the moving apparatus by an amount corresponding to the rotation detection signal.

The manual rotating handle is provided with a rotational-torque varying apparatus that varies a rotational torque that is a torque needed to rotate the manual rotating handle.

The control apparatus receives the proximity detection signal to control the rotational-torque varying apparatus in accordance with a state of proximity between the workpiece and the grinding wheel based on the proximity detection signal.

In the above aspect, the rotational-torque varying apparatus is controlled in accordance with the state of proximity between the workpiece and the grinding wheel. For example, in the state of proximity immediately before or at a time point when the workpiece and the grinding wheel come into contact with each other, the rotational torque of the manual rotating handle is increased. Accordingly, the operator can feel the contact between the grinding wheel and the workpiece (or a state immediately before the contact) and appropriately avoid operating the grinding wheel to significantly cut into the workpiece without recognizing the contact between the grinding wheel and the workpiece. Therefore, the grinding machine, which includes the manual rotating handle provided with the rotation detector that outputs the rotation detection signal that is an electric signal corresponding to the amount of rotation resulting from the operator's manual operation so that the position of the grinding wheel with respect to the workpiece can be relatively moved in accordance with the rotation detection signal, allows the operator to feel the state of proximity between the grinding wheel and the workpiece and assists accurate machining based on the operator's manual operation.

According to another aspect of the present invention, in the grinding machine according to the above aspect, upon determining that the state of proximity between the workpiece and the grinding wheel is such that the workpiece and the grinding wheel are in contact with each other, the control apparatus controls the rotational-torque varying apparatus such that the rotational torque of the manual rotating handle increases above the rotational torque exerted when the workpiece and the grinding wheel are not in contact with each other.

In the above aspect, when the workpiece and the grinding wheel are determined to be in contact with each other, the rotational-torque varying apparatus is controlled to increase the rotational torque of the manual rotating handle above the rotational torque exerted when the workpiece and the grinding wheel are not in contact with each other. Consequently, the operator can be appropriately and easily feel a timing when the workpiece and the grinding wheel come into contact with each other. Therefore, the operator can appropriately avoid operating the grinding wheel to further cut into the workpiece in spite of the contact between the grinding wheel and the workpiece. The aspect thus allows assistance of accurate machining based on the operator's manual operation.

According to yet another aspect of the present invention, in the grinding machine according to the above aspect, the rotational-torque varying apparatus includes: a handle shaft supported so as to be rotatable around a rotation axis of the manual rotating handle, and a pressing member that is disposed so as to face the handle shaft and that is pressed against the handle shaft facing the pressing member, under a pressing force adjusted by a control signal from the control apparatus.

According to still another aspect of the present invention, in the grinding machine according to the above aspect, the rotational-torque varying apparatus has a shaft integral member that rotates integrally with a handle shaft, and a pressing member disposed so as to face the shaft integral member and pressed against the shaft integral member facing the pressing member, under a pressing force adjusted by a control signal from the control apparatus.

In the above aspects, the rotational-torque varying apparatus can be appropriately implemented with the handle shaft and the pressing member or the shaft integral member and the pressing member.

According to further another aspect of the present invention, the grinding machine in the above aspect includes an air regulating apparatus that enables adjustment of a flow rate of compressed air fed from an air source, and the control apparatus adjusts the flow rate of the compressed air from the air regulating apparatus to adjust the pressing force applied to the pressing member, in accordance with the state of proximity between the workpiece and the grinding wheel.

In the above aspects, the pressing force applied to the pressing member can be adjusted simply by controlling the air regulating apparatus using the control apparatus, allowing the rotational torque of the manual rotating handle to be easily varied.

According to further another aspect of the present invention, in the grinding machine according to the above aspect, the rotation detector attached to an indirect rotating member that is rotated, via a predetermined rotational power transmitting member, by a direct rotating member that rotates integrally with the manual rotating handle.

In the above aspects, the rotation detector that outputs the rotation detection signal is attached to the indirect rotating member that is rotated via a rotational-power transmitting member such as a gear and a belt rather than to the direct rotating member that is directly rotated by rotation of the manual rotating handle. Thus, when the rotational torque is changed, delay attributed to play of the gear, the belt, or the like is intentionally caused, so that the operator's feeling is made similar to a feeling obtained from a conventional mechanical grinding wheel that uses oil pressure.

BRIEF DESCRIPTION OF THE DRAWINGS

FIG. 7 is a diagram of example distance (between the workpiece and the grinding wheel) vs. rotational-torque characteristics observed when the rotational torque of the manual rotating handle is set to be increased at the time point when the workpiece and the grinding wheel come into contact with each other and to be further increased according to the amount of cut-in.

MODES FOR CARRYING OUT THE INVENTION

Modes for carrying out the present invention will be described below with reference to the drawings. In figures illustrating an X axis, a Y axis, and a Z axis, the X axis, the Y axis, and the Z axis are orthogonal to one another. A Y-axis direction represents an upward direction of the vertical direction, an X-axis direction represents a direction in which a grinding wheel 22 cuts into a workpiece W, and a Z-axis direction represents a direction parallel to a workpiece rotation axis ZJ.

Figure 1:
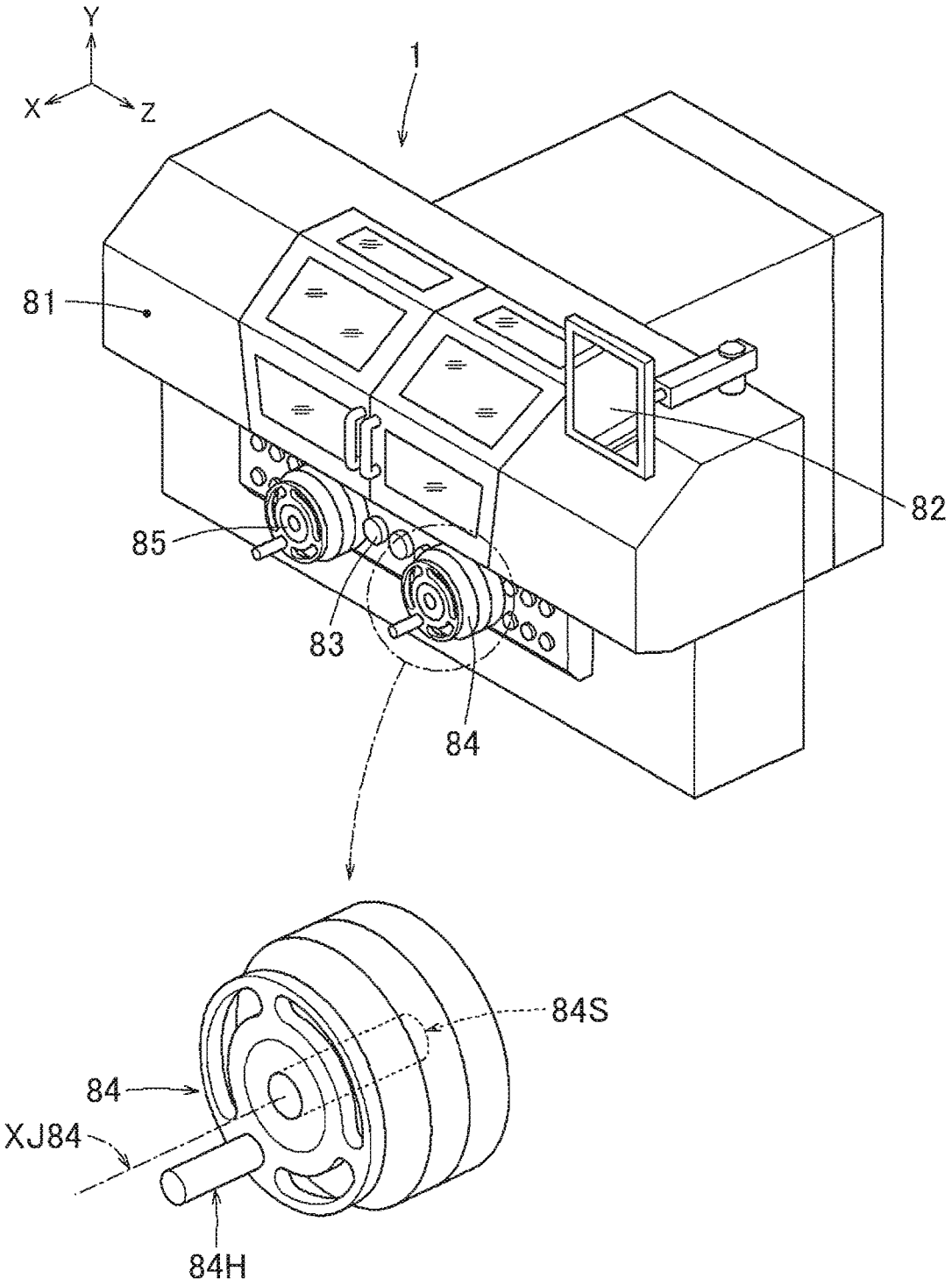
FIG. 1 is a perspective view of the appearance of a grinding machine according to an embodiment.

As depicted in FIG. 1, a grinding machine 1 is covered by a cover 81 in order to ensure an operator's safety and includes a display apparatus 82, various input apparatuses 83, and manual rotating handles 84, 85. The display apparatus 82 displays a state of the operator's input to the grinding machine 1 (setting state), an operational state of the grinding machine 1, and the like. The various input apparatuses 83 are apparatuses that accept the operator's input for switching between an automatic operation mode and a manual operation mode, various settings, and the like. The details of the inside of the cover 81 and the like will be described below using FIG. 2 and FIG. 3.

Figure 2:
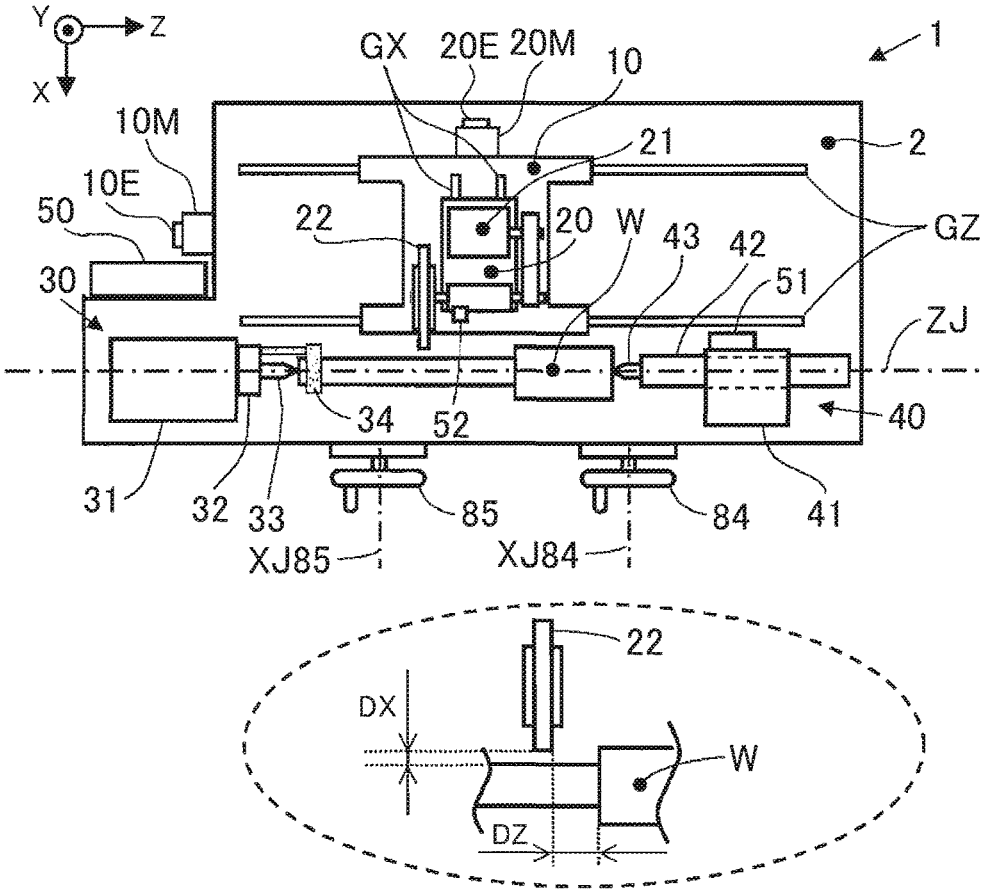
FIG. 2 is a plan view illustrating an example internal structure of a cover of the grinding machine.
Figure 3:
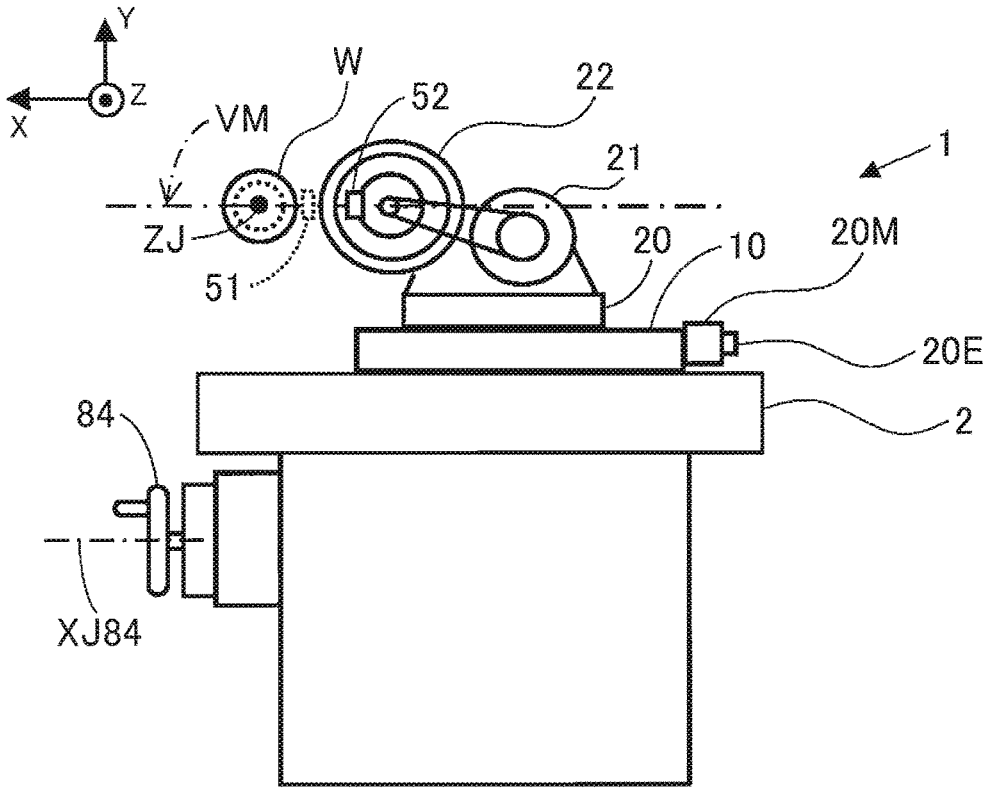
FIG. 3 is an example right side view of FIG. 2 in which illustration of a main spindle apparatus, a tailstock apparatus, and the like is omitted.

FIG. 2 is a plan view of the grinding machine 1 depicting an internal configuration of the cover 81 in FIG. 1, and FIG. 3 is a right side view of the cover 81. Unlike in FIG. 2, in FIG. 3, illustration of a spindle apparatus 30, a tailstock apparatus 40, and the like is omitted. As depicted in FIG. 2 and FIG. 3, the grinding machine 1 has a base 2, a slide table 10, an advancing and retracting table 20, the grinding wheel 22, the spindle apparatus 30, the tailstock apparatus 40, a control apparatus 50 (corresponding to a control apparatus), and the manual rotating handles 84, 85.

The slide table 10 can be moved along a Z-axis direction guide GZ provided on the base 2 parallel to the Z-axis direction, by use of a Z-axis direction driving motor 10M (corresponding to a moving apparatus) provided on the base 2. The control apparatus 50 controls the position of the slide table 10 (the grinding wheel 22 on the slide table 10) on the base 2 in the Z-axis direction based on inputs and command values for the position in the Z-axis direction from an encoder 10E of the Z-axis direction driving motor 10M.

The advancing and retracting table 20 can be moved along an X-axis direction guide GX provided on the slide table 10 and parallel to the X-axis direction, by use of an X-axis direction driving motor 20M (corresponding to a moving apparatus) provided on the slide table 10. The control apparatus 50 controls the position of the advancing and retracting table 20 (and the grinding wheel 22 located on the advancing and retracting table 20) on the base 2 in the X-axis direction based on output signals and command values for the position in the X-axis direction from an encoder 20E of the X-axis direction driving motor 20M.

On the advancing and retracting table 20, the cylindrical grinding wheel 22 is mounted which grinds the workpiece W, and a grinding wheel driving motor 21 is also mounted which rotationally drives the grinding wheel 22 via a power transmission apparatus such as a belt. Based on the command value, the control apparatus 50 outputs a control signal to the grinding wheel driving motor 21 to rotationally drive the grinding wheel 22.

The spindle apparatus 30 is provided on the base 2 to support a first end of the workpiece W, while rotating the workpiece W around a workpiece rotation axis ZJ. The spindle apparatus 30 has a headstock 31 fixed to the base 2, a main spindle 32 housed in the headstock 31 and rotationally driven around the workpiece rotation axis ZJ, a spindle center 33 that rotates integrally with the main spindle 32, and a gripping member 34 that rotates integrally with the main spindle 32 while gripping the workpiece W. The control apparatus 50 controls rotation of the main spindle 32 based on the command value. As depicted in FIG. 3, a rotation axis of the grinding wheel 22 and the workpiece rotation axis ZJ of the workpiece W are on the same virtual plane VM (a plane parallel to both the X axis and the Z axis).

The tailstock apparatus 40 is provided on the base 2 to support a second end of the workpiece W, while pushing the supported workpiece W toward the spindle apparatus 30 so that the workpiece W is rotatable around the workpiece rotation axis ZJ. The tailstock apparatus 40 has a tailstock stock 41 fixed to the base 2, a ram 42 that is housed in the tailstock stock 41, biased toward the spindle apparatus 30, and that is supported so as to be rotatable around the workpiece rotation axis ZJ, and a tailstock center 43 that rotates integrally with the ram 42.

The manual rotating handle 84 is a handle used to relatively move the grinding wheel 22 in a direction in which the grinding wheel 22 cuts into the workpiece W (the X-axis direction in FIG. 2) in accordance with the operator's rotating operation in the manual operation mode. For example, the manual rotating handle 84 has a handle shaft 84S supported so as to be rotatable around a rotation axis XJ84 and an auxiliary handle 84H that assists the operator's rotating operation, as depicted in an enlarged view in FIG. 1. The manual rotating handle 85 is a handle used to relatively move the grinding wheel 22 in a direction parallel to the workpiece rotation axis (the Z-axis direction in FIG. 2) in accordance with the operator's rotating operation.

In the grinding machine 1, proximity detectors 51, 52 are provided at predetermined positions. The proximity detectors 51, 52 are, for example, acoustic sensors, gap sensors, or distance measuring sensors and output proximity detection signals corresponding to a distance between the grinding wheel 22 and the workpiece W. When, for example, the proximity detectors are acoustic sensors, the proximity detectors are attached to a position depicted by reference numeral 52 in FIG. 2, in other words, a workpiece-side end of the advancing and retracting table 20 with the grinding wheel 22 mounted thereon, or a position depicted by reference numeral 51, in other words, on a side surface of the tailstock stock 41. When the grinding wheel 22 and the workpiece W come into contact with each other in the X-axis direction or in the Z-axis direction, the proximity detectors output the proximity detection signal, which is indicative of the contact. When, for example, the proximity detectors are gap sensors or distance measuring sensors, the proximity detectors are attached to the position denoted by reference numeral 52 or the position denoted by reference numeral 51 in FIG. 2, as is the case with acoustic sensors. The proximity detectors detect a distance DX between the grinding wheel 22 and the workpiece W in the X-axis direction or a distance DZ between the grinding wheel 22 and the workpiece W in the Z-axis direction to output the proximity detection signal to the control apparatus 50. The type, arrangement positions, and the like of the proximity detectors are not limited to these embodiments.

In the grinding machine 1 in the present embodiment, when the operator rotates the manual rotating handles 84, 85 in the manual operation mode, the rotation detector outputs a rotation detection signal that is an electric signal corresponding to the amount of the rotation. The control apparatus receives the rotation detection signal and controls the X-axis direction driving motor or the Z-axis direction driving motor to change the position of the grinding wheel relative to the workpiece. In the case of a conventional hydraulic grinding machine, rotation of the manual rotating handle allows pressure to be applied to hydraulic oil, and when the grinding wheel and the workpiece come into contact with each other, the rotational torque (the torque needed for rotation) of the manual rotating handle is automatically increased. Thus, the operator feels the contact between the grinding wheel and the workpiece and operates the grinding wheel to finely (delicately) cut into the workpiece from the contact position to achieve accurate machining. However, in recent grinding machines that output a rotation detection signal for the manual rotating handle, instead of applying pressure to the hydraulic oil via rotation of the manual rotating handle, the rotational torque of the manual rotating handle is not changed even when the grinding wheel and the workpiece come into contact with each other. Consequently, the operator has much difficulty in knowing a timing when the grinding wheel and the workpiece come into contact with each other. Thus, the operator may operate the grinding wheel to further cut into the workpiece without recognizing the contact between the grinding wheel and the workpiece and fail to achieve accurate machining. In the grinding machine in the present application, the rotational torque of the manual rotating handle can be varied according to the state of proximity between the grinding wheel and the workpiece as described below.

Now, using FIG. 4, an example of a system will be described in which the rotational torque of the manual rotating handle 84 can be varied when the grinding wheel 22 is moved in the X-axis direction relative to the workpiece W in accordance with rotation of the manual rotating handle 84. The control apparatus 50 receives the proximity detection signal from the proximity detector 51 (or the proximity detector 52), the detection signal from the encoder 20E, and the rotation detection signal from an encoder 84E (corresponding to the rotational torque) corresponding to the amount of rotation of the manual rotating handle 84. The control apparatus 50 outputs a control al to the X-axis direction driving motor 20M and also outputs a control signal to a pressure-regulating solenoid valve 61.

The proximity detectors 51, 52 output, to the control apparatus 50, the proximity detection signal corresponding to the state of proximity between the grinding wheel 22 and the workpiece W in the X-axis direction. Based on the proximity detection signal, for example, the control apparatus 50 can determine that the grinding wheel 22 is in contact with the workpiece W or that the grinding wheel 22 and the workpiece W are not in contact with each other. Furthermore, given that the grinding wheel 22 and the workpiece W are not in contact with each other, the control apparatus 50 can determine the distance between the grinding wheel 22 and the workpiece W. For amplification of subtle proximity detection signals from the proximity detectors 51, the signals may be relayed by amplifiers 51A, 52A.

The encoder 20E outputs the detection signal corresponding to the amount of rotation of the X-axis direction driving motor 20M to the control apparatus 50. The encoder 84E is rotated by the manual rotating handle 84 via a gear 84G and a gear 94G to output the rotation detection signal corresponding to the amount of rotation of the manual rotating handle 84 to the control apparatus 50. The encoder 84E receives a setting signal from a scale changing apparatus 84B and outputs a rotation detection signal corresponding to a rotation angle and a scale. The control apparatus 50 outputs, to the X-axis direction driving motor 20M, a control signal based on the rotation detection signal from the encoder 84E and the detection signal from the encoder 20E, so as to feedback-control the position of the grinding wheel 22 in the X-axis direction. For amplification of subtle proximity detection signals, the signals may be relayed by the amplifiers 51A, 52A. For amplification of a subtle proximity detection signal from the encoder 84E, the signal may be relayed by an amplifier 84A. The encoder 84E is preferably attached to an indirect rotating member (in this case, corresponding to a shaft 94S) that is indirectly rotated via a rotational-power transmitting member (in this case, corresponding to the gear 84G and the gear 94G) rather than to a direct rotating member (in this case, corresponding to the gear 84G, the handle shaft 84S, and a plate 84C) fixed to the manual rotating handle 84 and rotating directly and integrally with the manual rotating handle 84.

In this case, a delay attributed to play of the rotational-power transmitting member (the delay from actual rotation of the manual rotating handle until the rotation detection signal is output) is intentionally caused to allow the operator to have a feeling similar to a feeling obtained using the conventional hydraulic grinding machine. The amplifier 84A may have a function to cause a delay. Enabling adjustment of a delay time conveniently allows the delay time to be freely adjusted according to the operator's preferences.

A rotational-torque varying apparatus that makes the rotational torque of the manual rotating handle 84 variable includes the pressure-regulating solenoid valve 61, a regulator 62, a cylinder 94Q, a piston 94P, an elastic member 94D, a pressing member 94C, and the plate 84C. The pressure-regulating solenoid valve 61 (corresponding to an air regulating apparatus) is supplied with compressed air from an external compressed air supply apparatus or an air source such as a cylinder provided in the grinding machine. The valve lift of the pressure-regulating solenoid valve 61 and the like are adjusted based on control signals from the control apparatus 50. The flow rate of input compressed air is adjusted to convert the pressure of the input compressed air into a desired pressure, and the resultant air is output to the regulator 62. The regulator 62 outputs the air received from the pressure-regulating solenoid valve 61 to the cylinder 94Q. When air at a pressure higher than a predetermined pressure is input to the regulator 62, the regulator 62 limits the pressure to a preset predetermined value before outputting the air to the cylinder 94Q. This prevents air at a pressure equal to or higher than an allowable pressure from being input to the cylinder 94Q. In accordance with the state of proximity between the workpiece and the grinding wheel, the control apparatus 50 controls the pressure-regulating solenoid valve 61 to adjust the flow rate of the compressed air and thus a pressing force applied to the pressing member 94C, thereby regulating the rotational torque of the manual rotating handle 84.

The air input to the cylinder 94Q presses the piston 94P to press the pressing member 94C connected to the piston 94P against the plate 84C (corresponding to a shaft integral member), which rotates integrally with the handle shaft 84S. The pressing member 94C is biased in a direction away from the plate 84C by the elastic member 94D. When the pressing member 94C is pressed against the plate 84C, a friction force between the plate 84C and the pressing member 94C increases the rotational torque of the manual rotating handle 84. The control apparatus 50 increases or reduces the pressure of the air from the pressure-regulating solenoid valve 61 to increase or reduce the pressing force and thus the friction force, so that the control apparatus 50 increases or reduces the rotational torque of the manual rotating handle 84.

Figure 4:
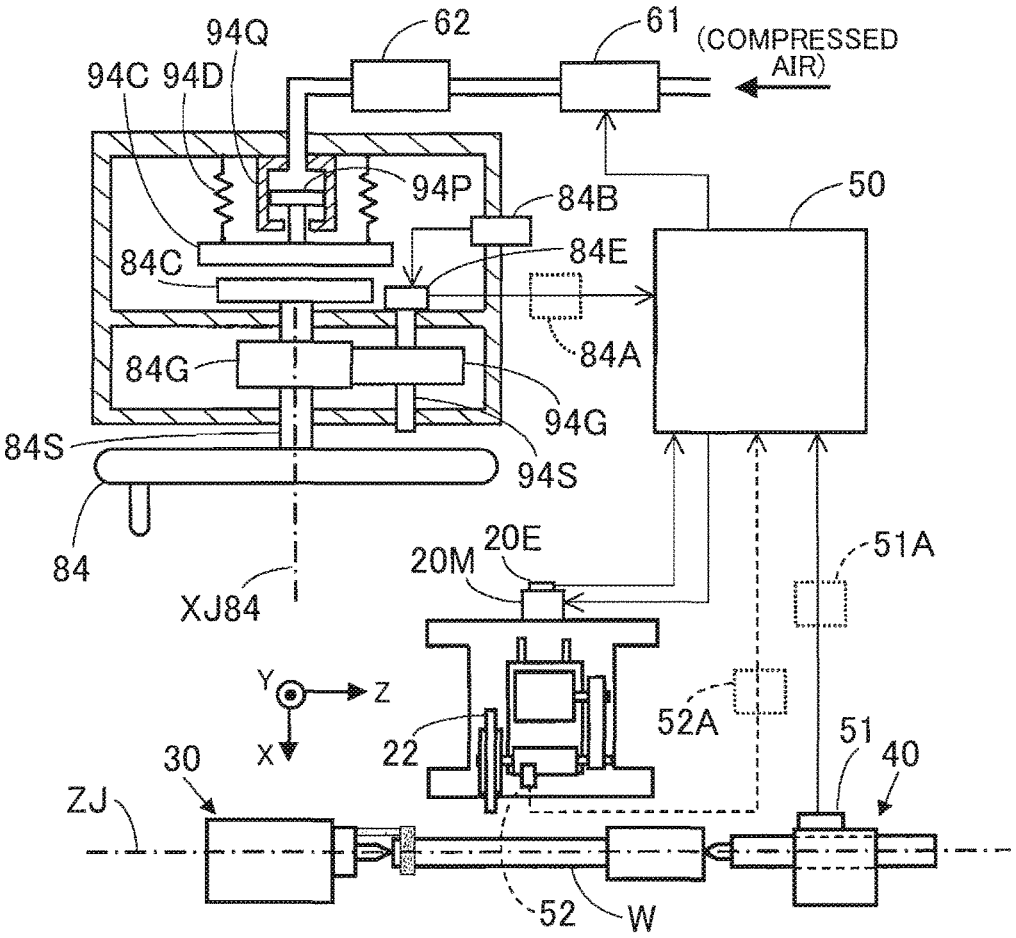
FIG. 4 is a diagram illustrating a system that varies the position of a grinding wheel relative to a workpiece and a rotational torque of a manual rotating handle in accordance with a rotation detection signal that is an electric signal from a rotation detector provided on the manual rotating handle.

The configuration and structure of the rotational-torque varying apparatus are not limited to the configuration and structure depicted in FIG. 4. For example, instead of being pressed against the plate 84C (shaft integral member), the pressing member 94C may be pressed against the handle shaft 84S. Instead of being pressed in a thrust direction (axial direction) with respect to the rotation axis XJ84 of the handle shaft 84S, the pressing member 94C may be pressed in a radial direction. The plate 84C and the pressing member 94C need not be like discs.

The control apparatus 50 allows the rotational torque of the manual rotating handle 84 to be freely adjusted in accordance with the state of proximity between the workpiece and the grinding wheel. An example of the state of change of the rotational torque with respect to the state of proximity will be described below using FIGS. 5 to 7.

Figure 5:
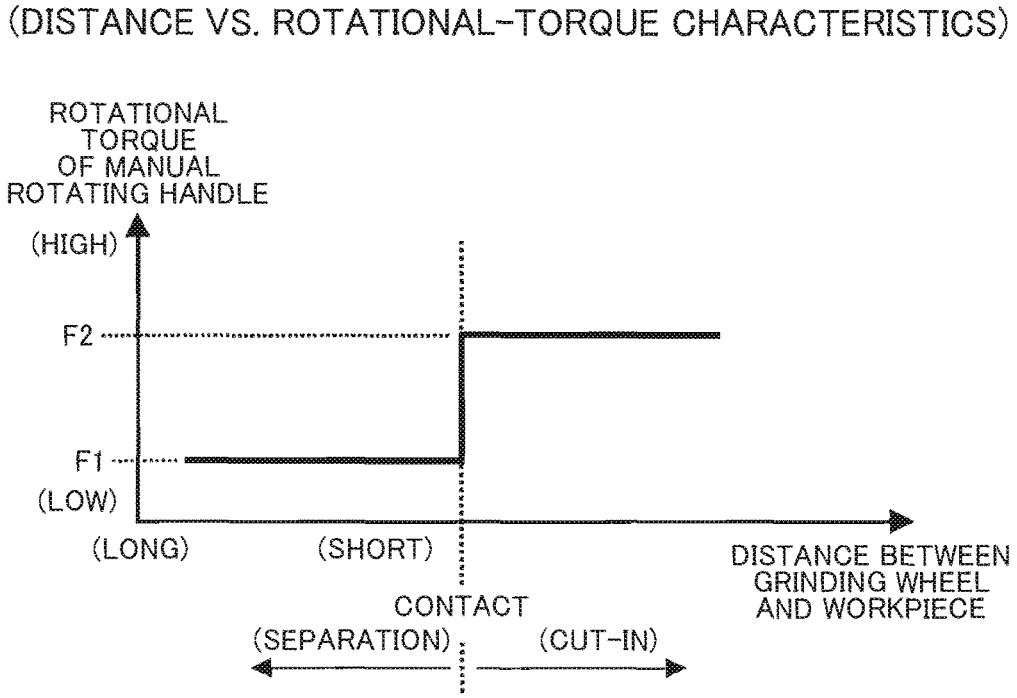
FIG. 5 is a diagram of example distance (between the workpiece and the grinding wheel) vs. rotational-torque characteristics observed when the rotational torque of the manual rotating handle is set to be increased at a time point when the workpiece and the grinding wheel come into contact with each other.

For example, based on the proximity detection signal from the proximity detector 51, the control apparatus 50 closes the pressure-regulating solenoid valve 61 to separate the pressing member 94C from the plate 84C while the grinding wheel 22 and the workpiece W are not in contact with each other. Upon determining that the grinding wheel 22 and the workpiece W are in contact with each other based on the proximity detection signal, the control apparatus 50 controls the valve lift of the pressure-regulating solenoid valve 61 to a predetermined value to press the pressing member 94C against the plate 84C under a predetermined pressing force. This state is depicted in FIG. 5. In FIG. 5, the axis of abscissas represents the distance between the grinding wheel and the workpiece. At a "contact" position, the grinding wheel and the workpiece come into contact with each other. An area to the left of the "contact" position indicates that the grinding wheel and the workpiece are separated from each other and that the distance increases leftward. An area to the right of the "contact" position indicates that the grinding wheel cuts into the workpiece and that the amount of cut-in increases rightward. In FIG. 5, the axis of ordinate represents the rotational torque of the manual rotating handle 84 and indicates that the rotational torque increases upward. F1 denotes a rotational torque exerted while the pressing member 94C and the plate 84C are separated from each other. Conveniently, a rotational torque F2 can be freely changed to a desired rotational torque value by the control apparatus 50 adjusting the valve lift of the pressure-regulating solenoid valve 61.

In this case, when the operator rotates the manual rotating handle 84 to make the grinding wheel 22 gradually closer to the workpiece W, the rotational torque of the manual rotating handle 84 is increased at the time point when the grinding wheel 22 and the workpiece W come into contact with each other. Thus, the operator can determine (feel) that the grinding wheel 22 and the workpiece W have come into contact with each other. At the time point of the contact, the operator can start to finely adjust the amount of rotation of the manual rotating handle 84 to achieve more accurate machining.

Figure 6:
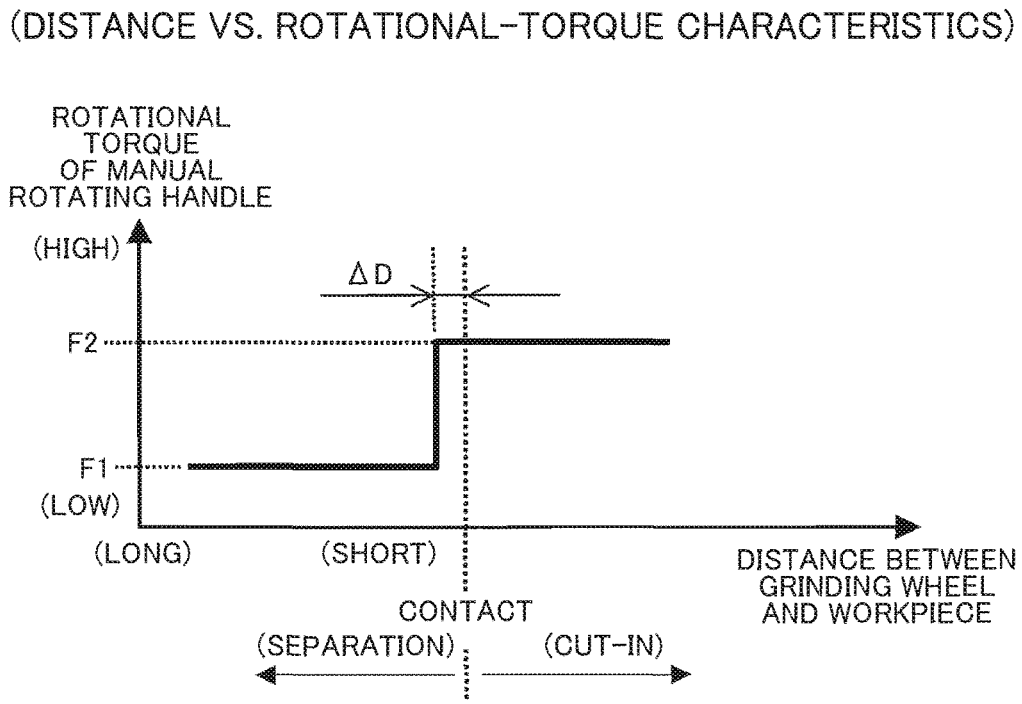
FIG. 6 is a diagram of example distance (between the workpiece and the grinding wheel) vs. rotational-torque characteristics observed when the rotational torque of the manual rotating handle is set to be increased before the workpiece and the grinding wheel come into contact with each other.

If distance vs. rotational-torque characteristics illustrated in FIG. 6 are applied, based on the proximity detection signal from the proximity detector 51, the control apparatus 50 closes the pressure-regulating solenoid valve 61 to separate the pressing member 94C from the plate 84C while the grinding wheel 22 and the workpiece W are not in contact with each other (the separation distance is larger than ΔD). Upon determining that the separation distance between the grinding wheel 22 and the workpiece W is equal to or shorter than ΔD (the grinding wheel 22 and the workpiece W are about to come into contact with each other) based on the proximity detection signal, the control apparatus 50 controls the valve lift of the pressure-regulating solenoid valve 61 to a predetermined value to press the pressing member 94C against the plate 84C under a predetermined pressing force.

In this case, the rotational torque of the manual rotating handle 84 is increased immediately before the grinding wheel 22 and the workpiece W actually come into contact with each other. Thus, the operator can recognize (feel) that the grinding wheel and the workpiece are now close enough to be about to come into contact with each other. Thus, at the position of the grinding wheel immediately before the contact, the operator can start to finely adjust the amount of rotation of the manual rotating handle 84 to achieve accurate machining. Conveniently, the separation distance ΔD can be freely set to a desired value by the control apparatus 50.

Figure 7:
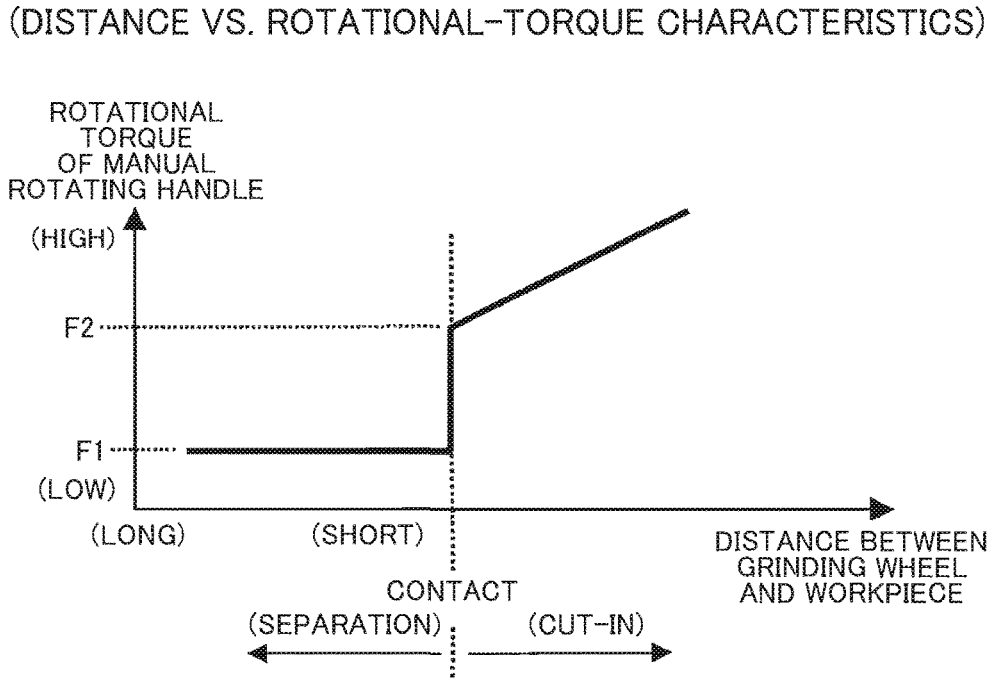

If distance vs. rotational-torque characteristics illustrated in FIG. 7 are applied, based on the proximity detection signal from the proximity detector 51, the control apparatus 50 closes the pressure-regulating solenoid valve 61 to separate the pressing member 94C and the plate 84C while the grinding wheel 22 and the workpiece W are not in contact with each other. Upon determining that the grinding wheel 22 and the workpiece W is in contact with each other based on the proximity detection signal, the control apparatus 50 controls the valve lift of the pressure-regulating solenoid valve 61 to a predetermined value to press the pressing member 94C against the plate 84C under a predetermined pressing force to adjust the rotational torque at the time point of the contact to F2 (a predetermined rotational torque larger than F1). Moreover, upon detecting that the amount of cut-in of the grinding wheel has increased based on the proximity detection signal from the proximity detector 51, the control apparatus 50 controls the pressure-regulating solenoid valve 61 by increasing or reducing the valve lift of the pressure-regulating solenoid valve 61 according to an increase or a decrease in the amount of cut-in so as to increase the rotational torque as the amount of cut-in increases.

In this case, the rotational torque increases and decreases as the amount by which the grinding wheel cuts into the workpiece increases or decreases. Thus, the operator can feel a variation in load on the grinding wheel corresponding to the amount of cut-in, and can achieve accurate machining while checking the load on the grinding wheel. Conveniently, the control apparatus 50 enables free setting to a desired value, regarding a characteristic such as the rate of increase (gradient) at which the rotational torque is increased with respect to the amount of cut-in of the grinding wheel.

The above description describes, movement of the grinding wheel 22 relative to the workpiece W in the X-axis direction by use of the manual rotating handle 84 and the X-axis direction driving motor 20M. The above description also applies to movement of the grinding wheel 22 relative to the workpiece W in the Z-axis direction by use of the manual rotating handle 85 and the Z-axis direction driving motor 10M (a contact feeling system the Z-axis direction is similar to the system in FIG. 4, and characteristics are similar to the characteristics in FIGS. 5 to 7). Thus, descriptions for the Z-axis direction are omitted.

Various changes, additions, and deletions may be made to the configuration, structure, appearance, characteristics, and the like of the grinding machine 1 in the present invention to the extent that the spirits of the present invention remain unchanged.

The configuration in which the grinding wheel is moved with respect to the workpiece in the X-axis direction is not limited to the configuration described in the present embodiment. Any configuration may be used so long as the grinding wheel can be moved relative to the workpiece in the X-axis direction. Similarly, the configuration in which the grinding wheel is moved with respect to the workpiece in the Z-axis direction is not limited to the configuration described in the present embodiment. Any configuration may be used so long as the grinding wheel can be moved relative to the workpiece in the Z-axis direction.

Or more (≥)or less (≤)more than (>), less than (<), and the like may or may not include an equal sign.

DESCRIPTION OF REFERENCE NUMERALS

1: grinding machine, 2: base, 10: slide table,

10M: Z-axis direction driving motor (moving apparatus), 20: advancing and retracting table,

20M: X-axis direction driving motor (moving apparatus), 22: grinding wheel,

30: spindle apparatus, 40: tailstock apparatus, 50: control apparatus (control apparatus),

51, 52: proximity detectors, 61: pressure-regulating solenoid valve (air regulating apparatus),

62: regulator, 84; manual rotating handle,

85: manual rotating handle, 84C: plate (shaft integral member),

84E: encoder (rotation detector), 84G: gear (rotational-force transmitting apparatus),

94G: gear (rotational-force transmitting apparatus),

84S: handle shaft (direct rotating member),

94C: pressing member (rotational-torque varying apparatus),

94S: shaft (indirect rotating member), W: workpiece, ZJ; workpiece rotation axis

The invention claimed is:

1. A grinding machine comprising:

a grinding wheel that grinds a workpiece;

a moving apparatus that relatively moves a position of the grinding wheel with respect to the workpiece;

a proximity detector that outputs a proximity detection signal corresponding to a distance between the workpiece and the grinding wheel;

a manual rotating handle provided with a rotation detector that outputs a rotation detection signal that is an electric signal corresponding to an amount of rotation resulting from an operator's manual operation; and a control apparatus that receives the rotation detection signal to control the moving apparatus by an amount corresponding to the rotation detection signal, wherein the manual rotating handle is provided with a rotational-torque varying apparatus that varies a rotational torque that is a torque needed to rotate the manual rotating handle, and the control apparatus receives the proximity detection signal to control the rotational-torque varying apparatus in accordance with a state of proximity between the workpiece and the grinding wheel based on the proximity detection signal, wherein the rotational-torque varying apparatus includes:

a handle shaft supported so as to be rotatable around a rotation axis of the manual rotating handle; and a pressing member that is disposed so as to face the handle shaft and that is pressed against the handle shaft facing the pressing member, under a pressing force adjusted by control from the control apparatus, wherein the grinding machine includes an air regulating apparatus that enables adjustment of a flow rate of compressed air fed from an air source, and the control apparatus adjusts the flow rate of the compressed air from the air regulating apparatus to adjust the pressing force applied to the pressing member, in accordance with the state of proximity between the workpiece and the grinding wheel.

2. The grinding machine according to claim 1, wherein upon determining the state of proximity between the workpiece and the grinding wheel based on the proximity detection signal is such that the workpiece and the grinding wheel are in contact with each other, the control apparatus controls the rotational-torque varying apparatus such that the rotational torque of the manual rotating handle increases above the rotational torque exerted when the workpiece and the grinding wheel are not in contact with each other.

3. The grinding machine according to claim 1, wherein the rotational-torque varying apparatus includes:

a shaft integral member that rotates integrally with a handle shaft supported so as to be rotatable around a rotation axis of the manual rotating handle; and a pressing member that is disposed so as to face the shaft integral member and that is pressed against the shaft integral member facing the pressing member, under a pressing force adjusted by a control signal from the control apparatus.

4. The grinding machine according to claim 2, wherein the rotational-torque varying apparatus includes:

a handle shaft supported so as to be rotatable around a rotation axis of the manual rotating handle; and a pressing member that is disposed so as to face the handle shaft and that is pressed against the handle shaft facing the pressing member, under a pressing force adjusted by control from the control apparatus.

5. The grinding machine according to claim 2, wherein the torque varying apparatus includes:

a shaft integral member that rotates integrally with a handle shaft supported so as to be rotatable around a rotation axis of the manual rotating handle; and a pressing member that is disposed so as to face the shaft integral member and that is pressed against the shaft integral member facing the pressing member, under a pressing force adjusted by a control signal from the control apparatus.

6. A grinding machine comprising:

a grinding wheel that grinds a workpiece;

a moving apparatus that relatively moves a position of the grinding wheel with respect to the workpiece;

a proximity detector that outputs a proximity detection signal corresponding to a distance between the workpiece and the grinding wheel;

a manual rotating handle provided with a rotation detector that outputs a rotation detection signal that is an electric signal corresponding to an amount of rotation resulting from an operator's manual operation; and a control apparatus that receives the rotation detection signal to control the moving apparatus by an amount corresponding to the rotation detection signal, wherein the manual rotating handle is provided with a rotational-torque varying apparatus that varies a rotational torque that is a torque needed to rotate the manual rotating handle, and the control apparatus receives the proximity detection signal to control the rotational-torque varying apparatus in accordance with a state of proximity between the workpiece and the grinding wheel based on the proximity detection signal, wherein the rotational-torque varying apparatus includes:

a shaft integral member that rotates integrally with a handle shaft supported so as to be rotatable around a rotation axis of the manual rotating handle; and a pressing; member that is disposed so as to face the shaft integral member and that is pressed against the shaft integral member facing the pressing member, under a pressing force adjusted by a control signal from the control apparatus, and wherein the grinding machine includes an air regulating apparatus that enables adjustment of a flow rate of compressed air fed from an air source, and the control apparatus adjusts the flow rate of the compressed air from the air regulating apparatus to adjust the pressing force applied to the pressing member, in accordance with the state of proximity between the workpiece and the grinding wheel.

7. A grinding machine comprising:

a grinding wheel that grinds a workpiece;

a moving apparatus that relatively moves a position of the grinding wheel with respect to the workpiece;

a proximity detector that outputs a proximity detection signal corresponding to a distance between the workpiece and the grinding wheel;

a manual rotating handle provided with a rotation detector that outputs a rotation detection signal that is an electric signal corresponding to an amount of rotation resulting from an operator's manual operation; and a control apparatus that receives the rotation detection signal to control the moving apparatus by an amount corresponding to the rotation detection signal, wherein the manual rotating handle is provided with a rotational-torque varying apparatus that varies a rotational torque that is a torque needed to rotate the manual rotating handle, and the control apparatus receives the proximity detection signal to control the rotational-torque varying apparatus in accordance with a state of proximity between the workpiece and the grinding wheel based on the proximity detection signal, wherein upon determining the state of proximity between the workpiece and the grinding wheel based on the proximity detection signal is such that when the workpiece and the grinding wheel are in contact with each other, the control apparatus controls the rotational-torque varying apparatus such that the rotational torque of the manual rotating handle increases above the rotational torque exerted when the workpiece and the grinding wheel are not in contact with each other, wherein the rotational-torque varying apparatus includes:

a handle shaft supported so as to be rotatable around a rotation axis of the manual rotating handle; and a pressing member that is disposed so as to face the handle shaft and that is pressed against the handle shaft facing the pressing member, under a pressing force adjusted control from the control apparatus, wherein the grinding machine includes an air regulating apparatus that enables adjustment of a flow rate of compressed air fed from an air source, and the control apparatus adjusts the flow rate of the compressed air from the air regulating apparatus to adjust the pressing force applied to the pressing member, in accordance with the state of proximity between the workpiece and the grinding wheel.

8. A grinding machine comprising:

a grinding wheel that grinds a workpiece;

a moving apparatus that relatively moves a position of the grinding wheel with respect to the workpiece;

a proximity detector that outputs a proximity detection signal corresponding to a distance between the workpiece and the grinding wheel;

a manual rotating handle provided with a rotation detector that outputs a rotation detection signal that is an electric signal corresponding to an amount of rotation resulting from an operator's manual operation; and a control apparatus that receives the rotation detection signal to control the moving apparatus by an amount corresponding to the rotation detection signal, wherein the manual rotating handle is provided with a rotational-torque varying apparatus that varies a rotational torque that is a torque needed to rotate the manual rotating handle, and the control apparatus receives the proximity detection signal to control the rotational-torque varying apparatus in accordance with a state of proximity between the workpiece and the grinding wheel based on the proximity detection signal, wherein upon determining the state of proximity between the workpiece and the grinding wheel based on the proximity detection signal is such that when the workpiece and the grinding wheel are in contact with each other, the control apparatus controls the rotational-torque varying apparatus such that the rotational torque of the manual rotating handle increases above the rotational torque exerted when the workpiece and the grinding wheel are not in contact with each other, wherein the torque varying apparatus includes:

a shaft integral member that rotates integrally with a handle shaft supported so as to be rotatable around a rotation axis of the manual rotating handle; and a pressing member that is disposed so as to face the shaft integral member and that is pressed against the shaft integral member facing the pressing member, under a pressing force adjusted by a control signal from the control apparatus, wherein the grinding machine includes an air regulating apparatus that enables adjustment of a flow rate of compressed air fed from an air source, and the control apparatus adjusts the flow rate of the compressed air from the air regulating apparatus to adjust the pressing force applied to the pressing member, in accordance with the state of proximity between the workpiece and the grinding wheel.

9. The grinding machine according to claim 1, wherein the rotation detector is attached to an indirect rotating member that is rotated with the manual rotating handle, with play between the rotation of the manual rotating handle and the rotation o the indirect rotating member.

10. The grinding machine according to claim 6, wherein the rotation detector is attached to an indirect rotating member that is rotated with the manual rotating handle, with play bet wen the rotation of the manual rotating handle and the rotation of the indirect rotating member.

11. The grinding machine according to claim 7, wherein the rotation detector is attached to an indirect rotating member that is rotated with the manual rotating handle, with play between the rotation of the manual rotating handle and the rotation of the indirect rotating member.

12. The grinding machine according to claim 8, wherein the rotation detector is attached to an indirect rotating member that is rotated with the manual rotating handle, with play between the rotation of the manual rotating handle and the rotation of the indirect rotating member.

* * * * *